US005230582A

United States Patent [19]

Schmitt et al.

[11] Patent Number: 5,230,582

[45] Date of Patent: Jul. 27, 1993

[54] HIGHWAY DIVIDER

[75] Inventors: Karl-Heinz Schmitt, Hasborn Dautweiler; Dieter Schönauer, Montabaur, both of Fed. Rep. of Germany

[73] Assignee: Spig Schutzplanken-Producktions-Gesellschaft mbH & Co. KG, Schmelz-Limbach, Fed. Rep. of Germany

[21] Appl. No.: 718,690

[22] Filed: Jun. 21, 1991

[30] Foreign Application Priority Data

Jun. 21, 1990 [EP] European Pat. Off. ..... 90111745

[51] Int. Cl.[5] ..... E01F 13/00

[52] U.S. Cl. ..... 404/6

[58] Field of Search ..... 404/6; 52/102; 47/33

[56] References Cited

U.S. PATENT DOCUMENTS

| | | | |
|---|---|---|---|
| 1,175,962 | 3/1916 | Latham | 404/6 X |
| 4,496,264 | 1/1985 | Casey | 404/6 |
| 4,632,598 | 12/1986 | Richards | 404/6 |
| 5,074,705 | 12/1991 | Schmitt | 404/6 |
| 5,104,254 | 4/1992 | Durand | 404/6 |

FOREIGN PATENT DOCUMENTS

| | | |
|---|---|---|
| 452893 | 10/1991 | European Pat. Off. . |
| 535895 | 11/1955 | Italy . |

*Primary Examiner*—Ramon S. Britts
*Assistant Examiner*—Roger J. Schoeppel
*Attorney, Agent, or Firm*—Anderson Kill Olick & Oshinsky

[57] ABSTRACT

A highway divider including a plurality of housing-like steel divider members which are releasably connected to each other in longitudinal direction. Each divider member has two side walls arranged in a mirror-inverted configuration. Each side wall includes a lower longitudinal strip member, a center longitudinal strip member and an upper longitudinal strip member which are connected to each other through concave portions so as to prevent buckling. Transverse wall members which are I-shaped in cross-section and have bottom surfaces are welded to the side walls on the vertical level of the lower longitudinal strip members and of the lower concave portions. In addition, horizontally extending stiffening plates can be welded between the side walls on the vertical level of the upper sides of the transverse wall members and the vertically middle portion of the center longitudinal strip members. Two successive divider members are connected through shaped pieces, connecting plates and threaded bolts.

20 Claims, 2 Drawing Sheets

HIGHWAY DIVIDER

BACKGROUND OF THE INVENTION

1. Field of the Invention

The present invention relates to a highway divider including a plurality of housing-like steel divider members which are releasably joined together in longitudinal direction. Each divider member has at least two transverse wall members located near the bottom of the divider member. The transverse wall members are arranged spaced apart and extend parallel to each other. Each divider member further includes essentially inclined side walls which are supported by the transverse wall members in a mirror-inverted configuration relative to a vertical longitudinal center plane. The side walls have, at the top thereof, laterally projecting longitudinal beads and the edge portions of the side walls are beveled downwardly in the form of strips.

2. Description of the Related Art

A highway divider of the above-described type is known from German Utility Model 18 70 841. In this known highway divider, the transverse wall members near the bottom of each steel highway divider member are integrally formed components of triangular plates which are recessed in the center thereof. The transverse wall members are formed by beveling, by 90°, the edge portions near the bottom of the plate. The edge portions of the two other sides of the plates are inclined in a roof-like manner relative to each other, are slightly concavely curved at the upper sides and are beveled by 90° in the same direction. The transverse wall members support side walls which are curved so as to correspond to the transverse wall members and are screwed to the beveled edge portions.

Ear-like projections are fastened to the rear sides of the plates in the horizontal plane of the bottom surfaces of the transverse wall member. So-called ground nails are driven through the ear-like projections into the ground and the transverse wall members are pulled toward the ground as a result.

The side walls have, at the upper ends thereof, longitudinal beads which are manufactured by bending such that the upper surfaces of the longitudinal beads extend in a horizontal plane and the lateral surfaces extend in parallel vertical planes.

The lower ends of the sidewalls are vertically downwardly beveled at a substantial distance next to the transverse wall members. In the same manner as the ground nails, the downwardly beveled portions anchor the steel highway divider member in the ground.

A significant disadvantage of the above-described known highway divider is the fact that it is anchored to the ground. As a result, when a motor vehicle strikes against the highway divider, this cannot yield laterally and provide an absorbing function. Moreover, it must be expected that a motor vehicle coming into contact with the highway divider can travel without problems over the individual highway divider members at any location thereof because the divider members are entering the ground and because the concavely-shaped side walls are inclined at an average angle of inclination of approximately 45° and the highway divider members are relatively low. Thus, this known highway divider is not capable of acting as a significant safety element and, therefore, such a highway divider is not suitable in practice.

Therefore, it is the object of the present invention to improve the above-described known highway divider, so that motor vehicles are absorbed in a cushioned manner and can be guided without substantial damage and injury to the passengers along the steel divider members which are releasably connected to each other, even if the motor vehicles strike with a force of approximately 30 tons or more and even if the impact is from a relatively large angle to the highway divider.

SUMMARY OF THE INVENTION

In accordance with the present invention, the above-described object is met by a combination of the following features:

Each side wall comprises three longitudinal strip members which are arranged one above the other and are connected to each other as to prevent buckling;

the center longitudinal strip member has a plane surface and extends at a slight angle of inclination relative to the vertical center longitudinal plane;

the lower longitudinal strip member has a plane surface and extends at a slight angle of inclination relative to the horizontal and is connected to the center longitudinal strip member through a concave portion;

the upper longitudinal strip member is curved cylindrically and is connected to the center longitudinal strip member through a concave portion;

the angle included between the lower longitudinal strip member and the center longitudinal strip member is greater than 100° and smaller than 120°;

a vertical plane extending tangentially to the upper longitudinal strip member intersects the center longitudinal strip member approximately in the middle portion thereof seen in vertical direction;

the transverse wall members are arranged vertically in the area of the lower longitudinal strip member and of the concave portion adjacent the lower longitudinal strip member and the ends of the transverse wall members are adapted to the inner contour of the concave portions; and the transverse wall members have a profiled cross-section and are provided with bottom surfaces which determine the resistance to displacement of the steel divider member.

A significant aspect of the present invention is the combined interaction of all individual features mentioned above. First of all, it is ensured that the weight of a motor vehicle which comes into contact with the steel divider member is specifically utilized for fixing in the case of an accident the so-called ASI value, i.e., the value which predominantly determines the maximum permissible load on the human body. As soon as a motor vehicle rolls with a wheel onto a lower longitudinal strip member, the resulting increased pressure of the bottom surfaces of the transverse wall members on the ground also increase the resistance due to friction. By taking into consideration the size of the individual bottom surfaces of the transverse wall members and the number of the transverse wall members in longitudinal direction of a steel divider member it is now possible based upon the properties of the ground surface exactly to determine the resistance due to friction between the bottom surfaces and the ground surface and, thus, the degree of lateral bending of the highway divider with a large bending radius. As a result, the deceleration forces acting on the human body can be exactly determined.

Accordingly, bending of the highway divider takes place as a function of the impact energy, however, under consideration of the magnitude of the respective weights resting on the highway divider. Consequently, when a heavy motor vehicle, for example, a truck having a weight of approximately 30 tons, strikes against the highway divider, bending of the highway divider is reduced because of the high weight resting on the highway divider and the resulting increased friction. On the other hand, a relatively lightweight motor bicycle rider striking against the highway divider is absorbed relative softly because in this case bending is essentially determined by the weight of the relatively light divider members and is not significantly reduced by the weight of the motor bicycle rider resting on the divider.

In this connection, the width of the lower longitudinal strip member is dimensioned specifically taking into consideration the width of truck wheels such that the lateral displacement of the highway divider can be clearly predetermined. The slight inclination of the lower longitudinal strip member relative to the horizontal provides the advantage that vehicle drivers can drive their motor vehicles without problems onto these longitudinal strip members and back down from these longitudinal strip members when they were forced, for whatever reason, to roll with the wheels of their vehicles onto the longitudinal strip members, particularly in narrow construction areas. The inclination of the longitudinal strip members which may be, for example, about 10°, does not affect or only insignificantly affects the driving behavior of the motor vehicles.

The concave portions between the lower longitudinal strips and the center longitudinal strips are dimensioned in such a way that, when taking into consideration the rounded wheel edges, they contribute in an advantageous manner to guide the vehicle wheels in longitudinal direction of the highway divider, without limiting the vehicle wheels to climb up along the center longitudinal strips. This climbing is further prevented by the steeply inclined center longitudinal strips. The inclination of the center longitudinal strips relative to the vertical longitudinal center plane is preferably about 10°.

The fact that the cylindrically curved upper longitudinal strip members protrude in relation to at least the upper portions of the center longitudinal strip members, another advantage is achieved in that the bodies of motor vehicles come into contact with this upper longitudinal strip member already when the vehicle wheels are still in the lower concave portions. In this manner, the upper longitudinal strip members also prevent the motor vehicles from crossing the highway divider and from turning over on the highway divider. On the other hand, it is still ensured that a contact between the bodies of the motor vehicles and the upper longitudinal strip member is excluded for as long as the vehicle wheels are still on the lower longitudinal strip members.

In the areas of the lower longitudinal strip members and of the adjacent concave portions, the transverse wall members not only have the function of determining the resistance due to friction, but also serve as stiffening elements for the steel highway divider members. For this purpose, the transverse wall members not only are adjusted to the inner contour of the side walls but also are welded thereto.

The highway divider according to the present invention can be placed directly on any common travel surface without requiring any anchoring. Consequently, it is possible to use the highway divider for narrowing lanes in the areas of construction sites while requiring relatively small space because the highway divider members are extremely narrow and because vehicles can travel on the lower strip members. In this connection, it is conceivable that the highway divider can be displaced particularly by machines which act on the upper longitudinal strip members. This possibility is preferably used in moving construction sites or in situations where the travel direction of individual lanes have to be quickly changed depending on the traffic volume. For this purpose, the individual highway divider members have a structurally caused inner flexibility and coupling members at the ends, in order to make it possible that the divider members can be better placed in curves.

The side walls of the divider member can be manufactured on appropriate machines as single pieces from a sheet metal blank by beveling. However, it is advantageous to manufacture each side wall individually and to weld the side walls together along the upper edges thereof in the vertical longitudinal center plane.

Another important aspect of the present invention is the fact that the highway divider does not have any sharp longitudinal edges and certainly no horizontal projections or recesses between structural components. Thus, in case of contact between a motor vehicle and the highway divider, the vehicle cannot be hooked to the highway divider and accidents with serious consequences due to hooking cannot occur. Accordingly, these situations are prevented at the outset. However, the lack of sharp longitudinal edges is particularly advantageous for two-wheel vehicles, especially motorcycles. Motor bicycle riders, which are in an accident and are thrown against a highway divider, cannot receive serious cuts from sharp longitudinal edges.

The interaction of all features of the present invention has the result that even in case of high impact forces with weights of possibly 30 tons and more, the deceleration as a result of the frictional contact of the transverse wall member with the ground is such that a motor vehicle striking the highway divider is absorbed essentially elastically and is positively guided while slidingly adhering to the side walls in longitudinal direction of the highway divider. There is no danger that the motor vehicle is thrown in an uncontrolled manner from the highway divider back into the highway lane. Nevertheless, the present invention essentially provides a relatively light-weight passive safety system which can be manipulated without problems. In addition, the highway divider members can be transported, while stacked one on top of the other.

With the significant safety features provided by the highway divider according to the present invention, it is now possible to arrange highway lanes immediately adjacent the highway divider. Safety distances of substantial magnitude are no longer required. This means that the space required for providing new sufficiently wide highways and highway lanes is reduced. When rearranging conventional multiple-lane highways with safety distances provided between the lanes, the safety distances can now be omitted and either wider lanes or even additional lanes can be created.

Depending on the location where the highway divider is used and the traffic volume at this location, while taking into consideration the surface properties of the travel surface, it may be useful to provide the bottom surfaces of the transverse wall members with a shape which increases the resistance due to friction or with a coating or lining which increases the resistance. Moreover, a mechanical or chemical treatment of the bottom surfaces, in order to increase the resistance due to friction, is conceivable. The bottom surfaces can also be provided with a coating which may be replaceable. In this manner, the coatings can be quickly exchanged and the highway divider can be adapted to different properties of the travel surface. Coatings of this type can be kept in storage or can be quickly made available in accordance with the respective requirements. When coatings are kept in storage, it is also possible to equip the highway divider with coatings having friction linings.

Any cross-sectional shape of the transverse wall members is possible. For example, a U-shaped or angularly-shaped cross-section is possible. Preferably, the transverse wall members have an I-shaped cross-section. Such a cross-section provides a high bending and twisting stiffness, while using the smallest possible cross-sectional area and the smallest possible amount of material. This reduces the weight of the highway divider member and thus makes it possible to manipulate the highway divider member more easily.

In accordance with another advantageous feature of the present invention, a horizontal plane extending tangentially to the longitudinal edges of the bevels at the lower longitudinal strip member, is located at a vertical distance above the bottom surfaces of the transverse wall members. This distance is kept as small as possible. This distance permits proper drainage of the highway divider. The bevels avoid sharp longitudinal edges and are therefore a preventive feature against the damage to vehicle wheels rolling onto the lower longitudinal strip members. In addition, the preferably slightly curved bevels extend in a protective manner around the end faces of the transverse wall members.

In accordance with a further advantageous feature, the ratio of the width of the highway divider member on the vertical level of the lower ends of the center longitudinal strip members relative to the width on the vertical level of the longitudinal edges of the bevels is approximately 1:3. This dimensional ratio contributes to a slender, narrow highway divider member. For example, preferred dimensions of the widths are approximately 300 mm on the vertical level of the lower ends of the center longitudinal strip members and 900 mm on the vertical level of the longitudinal edges of the bevels.

In order to obtain a slender highway divider member, the ratio of the width of the divider member in the middle in vertical direction of the upper concave portion relative to the width in the middle in vertical direction of the lower concave portion is approximately 1:2.5 to 1:3. In this case, advantageous dimensions of the widths are approximately 120 mm in the middle of the upper concave portion and approximately 340 mm in the middle of the lower concave portion.

If the dimensions of the divider member are such that the ratio of the width of the highway divider in the middle in vertical direction of the upper longitudinal strip member relative to the width on the vertical level of the longitudinal edges of the bevels is approximately 1:4 to 1:5, these dimensions lead to a stable configuration of the upper portion of the highway divider, on the one hand, and, on the other hand, the essentially tubular top portion laterally projects over the upper concave portions to such an extent that motor vehicles whose wheels have reached above the lower concave portions into the region of the center longitudinal strip member contact with their vehicle bodies the cylindrical surfaces of the upper longitudinal strip members. Thus, the motor vehicles are prevented from crossing the highway divider member. A preferred width in the middle in vertical direction of the upper longitudinal strip members is approximately 220 mm.

In accordance with an advantageous feature of the invention, the concave portions are circular segment-shaped, wherein the ratio of the radius of the upper concave portion to the radius of the lower concave portion is approximately 2:1. For example, the radius of the upper concave portion is about 230 mm and the radius of the lower concave portion is approximately 110 mm.

The above dimensions result in another advantageous dimensional ratio according to which the ratio of the radius of the lower concave portion to the width of the highway divider on the vertical level of the longitudinal edges of the bevels is approximately 1:8 to 1:8.5.

The highway divider has a sufficient height while taking into consideration the desired safety criteria if the ratio of the height of the highway divider member in the region of the vertical longitudinal center lane to the width on the vertical level of the longitudinal edges of the bevels is approximately 1:1.

The stiffness against twisting of the highway divider member is additionally increased by providing at least one horizontally extending stiffening wall member on the vertical level of the upper sides of the transverse wall members. The stiffening wall member may be a closed wall member over the surface area thereof or may be provided with recesses. The stiffening wall member is welded to the inner sides of the side walls. It is also conceivable to arrange two or more stiffening wall members spaced apart from each other in longitudinal direction. The stiffening wall member or members can extend over the entire length of a divider member or over only a portion of the length thereof.

In accordance with a further advantageous feature, the divider member is provided with at least one additional horizontally extending stiffening wall member approximately in the middle in vertical direction of the center longitudinal strip. These features also contribute to an increase of the load bearing capacity of the highway divider according to the present invention. The additional horizontal stiffening wall member may also be a single wall member or two or more particularly spaced-apart stiffening wall members may be provided. The additional stiffening wall member or members are also welded to the inner sides of the side walls.

The steel divider member can be additionally stiffened by providing the steel divider member at the ends of the stiffening wall members with vertical transverse web members which extend approximately over the height of the center longitudinal strip.

Two divider members, arranged next to each other in longitudinal direction of a highway divider, are advantageously coupled by means of shaped pieces which are arranged on the vertical level of the center longitudinal strip member and of the upper longitudinal strip member and whose shapes are adjusted to the inner contours thereof. The shaped pieces can be connected by means of screw connections without projections. The cross-sectional shape of the shaped pieces corresponds to the inner contours of the center longitudinal strip and of the upper longitudinal strip. This cross-sectional shape is approximately keyhole-shaped. For effecting the screw connection, the ends of the center longitudinal strip members and of the upper longitudinal strip members, as well as the shaped pieces, are provided with bores. Threaded bolts having heads with extremely flat spherically-shaped surfaces are inserted in the bores. The shaped pieces are then screwed on by appropriate nuts on the inside of the highway divider member.

In order to be able to mount and remove, without difficulties, the nuts from the threaded bolts, cutouts are provided in the side walls next to the screw connections. Each cutout preferably has an oval shape. The cutouts are located in such a way that no injuries can occur to drivers of two-wheel vehicles when they are in an accident and are thrown against the highway divider.

In order to connect also the lower longitudinal strip members of two successive steel divider members without projections, the longitudinal strip members can be coupled to each other by means of connecting plates which are screwed to the undersides thereof. The connecting plates are connected by means of screws in the same manner as the shaped pieces are connected to the center longitudinal strip members and upper longitudinal strip members.

Instead of the screw connections described above, the divider members can also be connected to each other, if necessary by means of plug and socket-type connections.

The tendency of a motor vehicle wheel to drive up a divider member is additionally reduced by making at least the surfaces of the center longitudinal strip members non-adherent. This can be obtained by providing an appropriate surface configuration, by a coating, by a lining or by a chemical or mechanical treatment.

In this connection, another advantageous feature provides that at least the surfaces of the center longitudinal strip members are coated with a thermosetting plastic material. Another advantageous property of the thermosetting plastic material is the fact that it can also provide a corrosion protection. The service life of the steel divider members is increased in this manner.

Although tests have shown that even in the case of substantial impact stresses the highway divider according to the present invention is fully effective without requiring any anchoring to the ground, it may be useful to fix the ends of a highway divider. Thus, the highway divider can be viewed as a multiple-member rubber band which is tensioned between two fixed points. Fixing the ends of a highway divider has an effect particularly in the case of shorter dividers in which the resilient action of a divider, tensioned between two fixed points, becomes fully effective. In the case of longer highway dividers, the weight of the steel divider members, located in front of and behind an impact area, can ensure by themselves, that after a lateral displacement of the highway divider which is limited to a certain location in the case of an impact, is subsequently again almost completely axially aligned.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE PREFERRED EMBODIMENT

Figure 1:
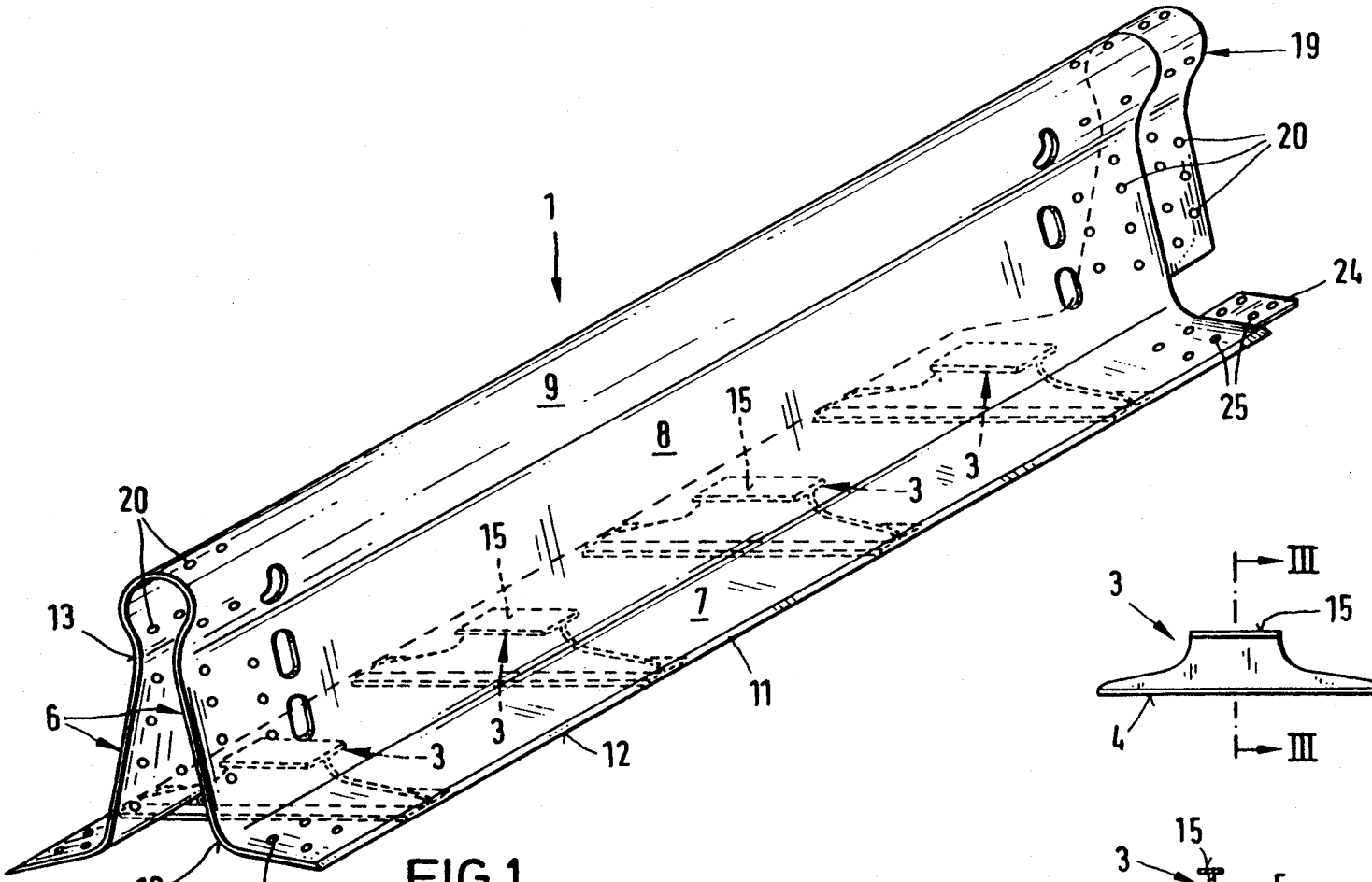
FIG. 1 is a schematic, perspective view of a highway divider member according to the present invention.
Figure 4:
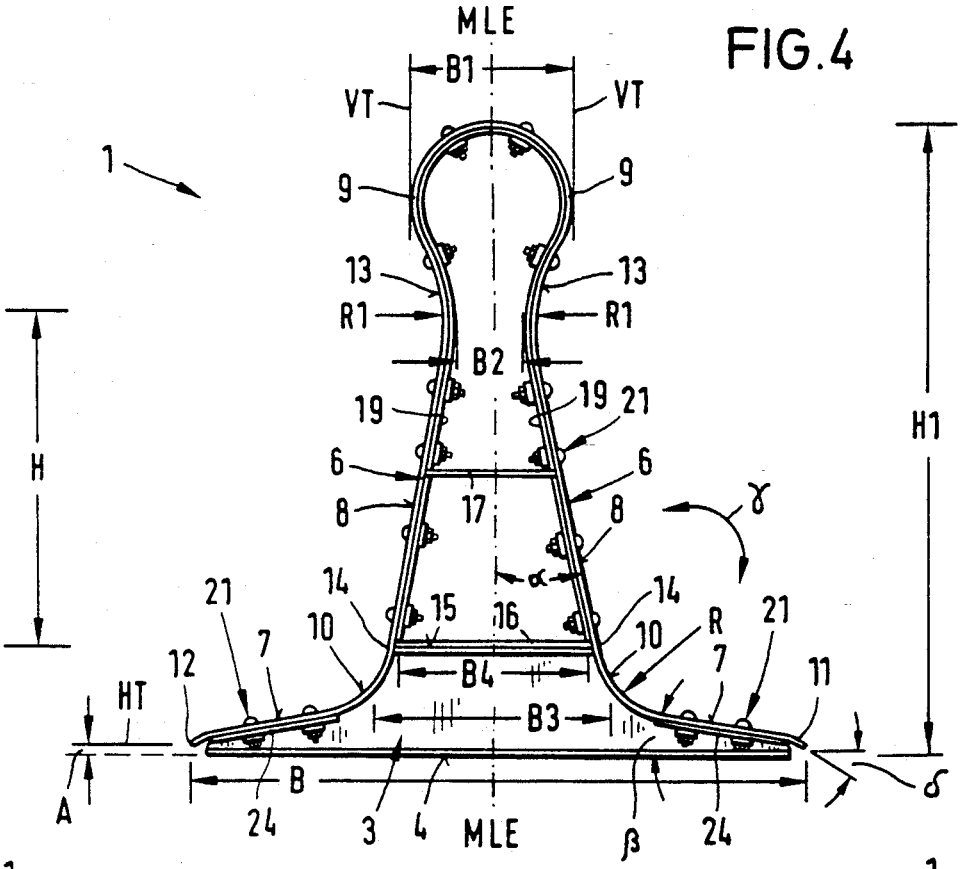
FIG. 4 is a front view of the highway divider member of FIG. 1.
Figure 5:
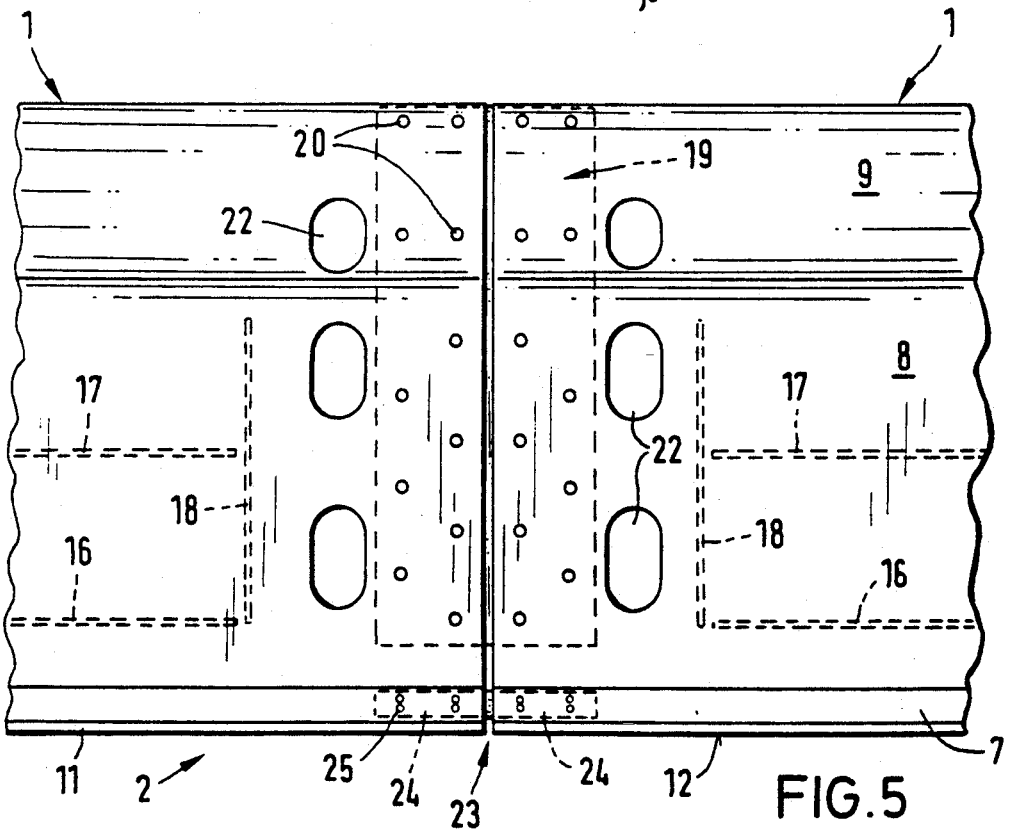
FIG. 5 is a side view of the joint area between two highway divider members of a highway divider.

In FIGS. 1, 4 and 5 of the drawing, reference numeral 1 denotes a steel highway divider member which, as shown in FIG. 5, can be releasably connected with other identical steel highway divider members 1 to form a highway divider 2 of any chosen length.

The steel divider member 1 includes four spaced-apart transverse wall members 3 which have an I-shaped cross-section. A transverse wall member 3 is illustrated in detail in FIG. 2 and the I-shaped cross-section thereof can be seen in FIG. 3. Because of the I-shaped cross-section, the transverse wall members 3 have bottom surfaces 4 whose total size depends on the length and width of the lower flanges 5 of the individual transverse wall members 3 and on the number of transverse wall members 3 provided in each divider member 1. The bottom surfaces 4 can be treated to obtain a greater friction.

The transverse wall members 3 form support elements for side walls 6, which are arranged mirror-inverted relative to the vertical longitudinal center plane MLE of the highway divider member 1. The sidewalls 6 are welded to each other at the tops thereof in the longitudinal center plane MLE.

As can be seen in FIGS. 1, 4 and 5, each side wall 6 has three longitudinal strip members 7, 8 and 9 which are arranged one above the other and in a manner to prevent buckling.

The center longitudinal strip member 8 is plane and has a height H of approximately 460 mm and extends downwardly inclined relative to the longitudinal center plane MLE at an angle $\alpha$ of approximately 10°.

The lower longitudinal strip member 7 is connected to the lower end 14 of the center longitudinal strip member 8 through rounded concave portion 10 having a radius R of approximately 110 mm. This lower longitudinal strip member 7 extends at an angle $\beta$ of about 10° relative to the horizontal. The free longitudinal edge 11 of the lower longitudinal strip member 7 is beveled downwardly relative to the horizontal at an angle $\beta$ of approximately 30°.

The angle $\tau$, defined between the center longitudinal strip member 8 and the lower longitudinal strip member 7, is 110°.

Figure 2:
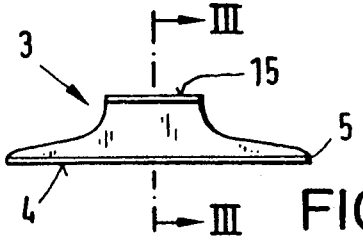
FIG. 2 is a side view of a transverse wall member of the divider member of FIG. 1.
Figure 3:
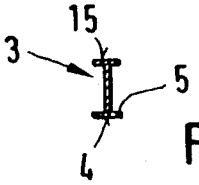
FIG. 3 is a vertical cross-section taken through FIG. 2 along sectional line III—III.

As illustrated in FIGS. 1 and 4, the transverse wall members 3 are mounted in vertical direction in the area of the concave portions 10 and the lower longitudinal strip members 7 and, as is shown in FIG. 2, are at the edges thereof adapted to the inner contour of the concave portions 10 and of the lower longitudinal strip members 7. The transverse wall members 3 are, at least over portions thereof, welded to the concave portions 10 and the lower longitudinal strip members 7.

As shown in FIG. 4, a horizontal tangential line HT, extending at the longitudinal edges 12 of the bevels 11, is spaced with a distance A of approximately 7 mm above the horizontal plane extending through the support surfaces 4 of the transverse wall members 3.

The upper longitudinal strip member 7, of each side wall 6, is cylindrically-shaped and is connected through a concave portion 13 with a radius R1 of about 230 mm to the upper end of the center longitudinal strip member 8.

The width B of the steel divider member 1, on the vertical level of the longitudinal edges 12 of the bevels 11, is about 900 mm. The height H1 of the steel divider member 1 in the area of the longitudinal center plane MLE is also 900 mm. Consequently, the ratio of width to height is 1:1.

A width B1 on the vertical level of the middle of the upper longitudinal strip member 9 of about 220 mm, a width B2 on the vertical level of the middle of the upper concave portion 19 of about 120 mm, and the inclination $\alpha$ of the center longitudinal strip member 8 and the inclination $\beta$ of the lower longitudinal strip member 7, result in the following dimensional ratios.

The ratio of the width B1 of the divider member 1 on the vertical level of the middle of the upper longitudinal strip member 9 relative to the width B of the steel highway divider member 1 on the vertical level of the longitudinal edges 12 of the bevels 11 is approximately 1:4. The ratio of the width B2 on the vertical level of the middle of the upper concave portion 13 relative to the width B on the vertical level of the free longitudinal edges 12 of the bevel edges 12 of the bevels 11 is approximately 1:7.5. The ratio of the width B2 of the steel divider member 1 on the vertical level of the middle of the upper concave portion 13, relative to the width B3 on the vertical level of the middle of the lower concave portion 10, is about 1:2.8. The width B4 of the steel divider member 1 on the vertical level of the lower ends 14 of the center longitudinal strip member 8 relative to the width B is approximately 1:3.

As also illustrated particularly in FIG. 4, the width B1 of the steel divider member 1 on the vertical level of the middle of the upper longitudinal strip member 9, the width B2 on the vertical level of the middle of the upper concave portion 13 and the inclination $\alpha$ of the center longitudinal strip 8, have the result that a vertically extending tangential line VT, extending parallel to the longitudinal center plane MLE contacting the upper longitudinal strip member 9, intersect the center longitudinal strip member 8 approximately on the center vertical level thereof.

As can be seen additionally in FIG. 4 and 5, a horizontally extending stiffening plate 16 is provided in the steel divider member 1 on the vertical level of the upper side 16 of the transverse wall members 3. The stiffening plate 16 is welded to the inner sides of the side walls 6. As shown in FIG. 5, the stiffening plate 16 does not extend over the entire length of the steel divider member 1.

Another horizontal stiffening plate 17 extends in the steel divider member 1 on the vertical level of the middle of the center longitudinal strip member 8. This stiffening plate 17 is also welded to the inner surfaces of the side walls 6.

In order additionally to stiffen the steel divider member 1, vertically extending transverse webs 18 are provided, as illustrated in FIG. 5. The transverse webs 18 are welded on the inside of the side walls 6 to the ends of the stiffening plates 16, 17 across the height of the center longitudinal strip 8.

As illustrated in FIGS. 1, 4 and 5, shaped pieces 19 are provided for connecting two steel divider members 1. The contours of the shaped pieces 19 are adapted to the inner contour of the upper longitudinal strip member 9 and the center longitudinal strip member 8. The contour of the shaped pieces 19 is approximately keyhole-shaped.

The end portions of the upper longitudinal strip members 9 and of the center longitudinal strip members 8, as well as the shaped pieces 19, have corresponding bores 20 through which threaded bolts 21 with flat spherically-shaped heads can be inserted. Nuts can be placed on the threaded bolts 21 through cutouts 22 next to the bores 20 in the center longitudinal strip member 8 and of the upper longitudinal strip member 9. Thus, the shaped pieces 19 can be fastened to the steel divider members 1, so that the joints 23 of two successive steel divider members 1 does not have any projections, as is clear from FIG. 5.

In order to ensure a connection without projection of two steel divider members 1 also in the region of the lower longitudinal strip members 7, plane connecting plates 24 are provided which can be screwed through corresponding bores 25, in the end portions of the lower longitudinal strip members 7 by means of threaded bolts 21 with spherically-shaped heads and with nuts.

While a specific embodiment of the invention has been shown and described in detail to illustrate the application of the inventive principles, it will be understood that the invention may be embodied otherwise without departing from such principles.

We claim:

1. In a highway divider including a plurality of housing-like steel divider members, the steel divider members being releasably joined together in longitudinal direction, each divider member having at least two transverse wall members located near a bottom of the divider member, the transverse wall members being arranged spaced apart and extending parallel to each other, each divider member further including inclined side walls, the side walls being supported by the transverse wall members in a mirror-inverted configuration relative to a vertical longitudinal center plane, the side walls having at a top thereof laterally projecting longitudinal beads, the side walls having bottom edge portions, the edge portions being beveled downwardly in the form of strips, the improvement comprising each side wall comprising three longitudinal strip segments, one above the other connected to each other in a single piece and to prevent buckling;

the center longitudinal strip member having a plane surface and extending at a slight angle of inclination relative to the vertical longitudinal center plane;

the lower longitudinal strip member having a plane surface and extending at a slight angle of inclination relative to the horizontal and being connected to the center longitudinal strip member through a first concave portion;

the upper longitudinal strip member being curved cylindrically to form the longitudinal bead and being connected to the center longitudinal strip member through a second concave portion;

the lower longitudinal strip member and the center longitudinal strip member including an angle of greater than 100° and smaller than 120°;

a vertical plan extending tangentially to the upper longitudinal strip member intersecting the center longitudinal strip member approximately in a middle portion thereof in vertical direction;

the transverse wall members being arranged vertically in the area of the lower longitudinal strip member and of the first concave portion the transverse wall members having ends which are adapted in shape to inner contours of the first concave portion; and the transverse wall members having a profiled cross-section and include bottom surfaces which determine the resistance to displacement of the steel divider member.

2. The highway divider according to claim 1, wherein the bottom surfaces of the transverse wall members have a surface configuration which increases the resistance due to friction.

3. The highway divider according to claim 1, wherein the bottom surfaces of the transverse wall members are provided with a coating for increasing the resistance due to friction.

4. The highway divider according to claim 1, wherein the transverse wall members have an I-shaped cross-section.

5. The highway divider according to claim 1, wherein the lower longitudinal strip members have beveled portions with lower longitudinal edges, a horizontal plane extending tangentially to the lower longitudinal edges being spaced at a vertical distance above the bottom surfaces of the transverse wall members.

6. The highway divider according to claim 5, wherein a ratio of a width of the divider member on the vertical level of the lower ends of the center longitudinal strip member to the width on the vertical level of the lower longitudinal edges of the bevel portions is approximately 1:3.

7. The highway divider according to claim 6, wherein a ratio of the width of the divider member in the middle in vertical direction of the second concave portion relative to the width in the middle in vertical direction of the first concave portion is approximately 1:2.5 to 1:3.

8. The highway divider according to claim 7, wherein a ratio of the width of the highway divider in the middle in vertical direction of the upper longitudinal strip member relative to the width on the vertical level of the lower longitudinal edges of the bevel portions is approximately 1:4 to 1:5.

9. The highway divider according to claim 7, wherein the first and second concave portions are circular segment-shaped, wherein a ratio of the radius of the second concave portion to the radius of the first concave portion is approximately 2:1.

10. The highway divider according to claim 7, wherein a ratio of the radius of the first concave portion to the width of the divider member on the vertical level of the lower longitudinal edges of the bevel portions is approximately 1:8 to 1:8.5.

11. The highway divider according to claim 5, wherein a ratio of the height of the divider member in the vertical longitudinal center plane relative to the width on the vertical level of the lower longitudinal edges of the bevel portions is approximately 1:1.

12. The highway divider according to claim 1, wherein the divider member has at least one horizontally extending stiffening wall member on the vertical level of the upper sides of the transverse members.

13. The highway divider according to claim 12, wherein the divider member includes at least one additional horizontally extending stiffening wall member located approximately in the middle in vertical direction of the center longitudinal strips.

14. The highway divider according to claim 12, wherein the divider member includes vertical transverse web members at ends of the stiffening wall members, the transverse web members extending approximately over the height of the center longitudinal strips.

15. The highway divider according to claim 1, comprising shaped pieces for connecting two successive divider members, each shaped piece being adapted in shape to the inner contours of the center longitudinal strip member and the upper longitudinal strip member, the shaped piece being connected by means of screw connections to the center longitudinal strip member and the upper longitudinal strip member.

16. The highway divider according to claim 15, wherein the side walls have cutouts located adjacent the screw connections.

17. The highway divider according to claim 1, comprising connecting plates screwed to the undersides of the lower longitudinal strip members for connecting two successive divider members.

18. The highway divider according to claim 1, wherein at least the surfaces of the center longitudinal strip members have anti-adherent properties.

19. The highway divider according to claim 18, wherein at least the surfaces of the center longitudinal strip members are coated with a thermosetting plastic material.

20. The highway divider according to claim 1, comprising means for fixing the ends of the highway divider members in longitudinal direction to the ground.

* * * * *